US011140474B1

(12) United States Patent
Sahyoun

(10) Patent No.: US 11,140,474 B1
(45) Date of Patent: Oct. 5, 2021

(54) ACOUSTIC RADIATORS WITH EDGE OVERLAPPING SUSPENSION

(71) Applicant: Joseph Yaacoub Sahyoun, Redwood City, CA (US)

(72) Inventor: Joseph Yaacoub Sahyoun, Redwood City, CA (US)

( * ) Notice: Subject to any disclaimer, the term of this patent is extended or adjusted under 35 U.S.C. 154(b) by 427 days.

(21) Appl. No.: 16/241,768

(22) Filed: Jan. 7, 2019

(51) Int. Cl.
*H04R 1/28* (2006.01)
*H04R 1/02* (2006.01)
*H04R 5/02* (2006.01)
*H04R 1/34* (2006.01)

(52) U.S. Cl.
CPC ..... *H04R 1/2857* (2013.01); *H04R 1/025* (2013.01); *H04R 1/345* (2013.01); *H04R 5/02* (2013.01)

(58) Field of Classification Search
CPC ..... H04R 1/2857; H04R 1/025; H04R 1/345; H04R 5/02
USPC ..... 181/199
See application file for complete search history.

(56) References Cited

U.S. PATENT DOCUMENTS 4,618,025 A * 10/1986 Sherman ..... H04R 1/22 181/148
6,418,231 B1 * 7/2002 Carver ..... H03F 1/0227 181/148
2004/0228500 A1 * 11/2004 Stiles ..... H04R 1/025 381/398
2004/0240701 A1 * 12/2004 Sahyoun ..... H04R 7/20 381/407
2013/0195311 A1 * 8/2013 Sahyoun ..... H04R 1/2896 381/395
2015/0125018 A1 * 5/2015 Clark ..... H04R 31/00 381/332
2016/0094909 A1 * 3/2016 Johnston ..... H04R 9/063 381/186
2016/0353198 A1 * 12/2016 Sahyoun ..... H04R 1/2834

* cited by examiner

*Primary Examiner* — Sean H Nguyen

(57) ABSTRACT

An active and passive radiator configuration and method is disclosed which provides surrounds overlapped on active moving elements of the acoustic radiators avoiding interference between the surround elements and adjacent pieces during acoustic radiator, active element motion, in operation. Single and dual suspension arrangements are described.

20 Claims, 10 Drawing Sheets

FRAME GUIDED SUSPENSION

FRAME GUIDED SUSPENSION

ACOUSTIC RADIATORS WITH EDGE OVERLAPPING SUSPENSION

FIELD OF THE INVENTION

The present invention relates to a novel speaker enclosure configuration with the speaker surround portions of an active or passive acoustic radiator overhanging (overlapping) a portion of the edge of the opening in the enclosure or the edge of the outer edge of the central radiating element of the respective active or passive acoustic radiator.

BACKGROUND OF THE INVENTION

The present invention is related to the construction of acoustic radiators, both active speakers and passive radiators, and more specifically acoustic radiators having a diameter that is larger than the enclosure opening to which the radiator mounts thus allowing the use of a smaller enclosure for a given capacity radiator.

A typical audio speaker has a housing or enclosure made of a relatively rigid material and one or more speaker drivers (active acoustic radiators) and one or more passive acoustic radiators. Commonly, speaker housings (enclosures) are made from plastic or wood, but can also be formed from other materials including carbon fiber, metal and/or composites. Typically, the speaker housing is finished in an aesthetically pleasing manner, for example, wooden speaker cabinets are often given any one of a variety of wood finishes. The finishes for plastics are often formed from the mold. Further finishing is sometimes provided, which finishing may be provided for aesthetic purposes. An opening in the housing is provided to permit radiation of sound from the speaker drivers. To protect the speaker drivers, in addition to finishing, speaker housings are frequently fitted with grilles, which are not attractive to users.

The speaker driver itself generally comprises a frame that is mounted to the housing, a moveably mounted cone or diaphragm and a surround that attaches the cone to the frame in a manner that permits appropriate motion. Speaker drivers can be active or passive as is well known in the art. In the case of active drivers, an electromechanical system for driving the speaker diaphragm is also necessary.

In manufacturing the speaker driver, the surround is attached to the diaphragm and the frame. In making the audio speaker, the frame is then mounted to the enclosure.

What is needed is a speaker and enclosure that overcomes the disadvantages of the prior art.

SUMMARY OF THE INVENTION

A speaker enclosure having: an enclosure wall having an inside surface and an outside surface, the enclosure wall having a continuous surface at a passive radiator location in the enclosure wall, a passive radiator opening at the passive radiator location in the enclosure wall extending through the wall from the inside surface of the wall to the outside surface of the wall, the passive radiator opening having an inside perimeter edge configuration; a passive radiator front plate configured to attach to the enclosure wall at the passive radiator location in the enclosure wall when positioned within passive radiator opening of the enclosure wall; the passive radiator front plate having an outside perimeter edge configuration complimentarily matching the passive radiator inside perimeter edge configuration such that when the passive radiator front plate is positioned approximately centered within the passive radiator opening of the enclosure wall there is a substantially continuous air gap having a uniform dimension between an outside perimeter edge of the passive radiator front plate and an inside perimeter edge of the enclosure wall in the annular space therebetween, a half annular shaped passive radiator surround having a diametral dimension around a surround annular center at least two times the uniform dimension of the continuous air gap between the outer edge of the passive radiator front plate and the inner edge of the passive radiator opening in the speaker enclosure. Where the half annular shaped passive radiator is positioned to span between and connect the passive radiator front plate and the enclosure wall in proximity to the passive radiator opening in the speaker enclosure such that a center of the diametral dimension of the surround is centered opposite a center of the continuous air gap between the outer edge of the passive radiator front plate and the inner edge of the passive radiator opening in the speaker enclosure. Where the half annular shaped passive radiator is positioned to span between and connect the passive radiator front plate and the enclosure wall in proximity to the passive radiator opening in the speaker enclosure such that an inner diametral perimeter of the surround is positioned located opposite and matching an outer perimeter edge of the passive radiator front plate. Where the half annular shaped passive radiator is positioned to span between and connect the passive radiator front plate and the enclosure wall in proximity to the passive radiator opening in the speaker enclosure such that an outer diametral perimeter of the surround is positioned located opposite and matching an inner perimeter edge of the passive radiator opening in the speaker enclosure. Where the half annular shaped passive radiator surround has a diametral dimension around the surround annular center at least three times the uniform dimension of the continuous air gap between the outer edge of the passive radiator front plate and the inner edge of the passive radiator opening in the speaker enclosure. Where the half annular shaped passive radiator surround has a diametral dimension around the surround annular center at least four times the uniform dimension of the continuous air gap between the outer edge of the passive radiator front plate and the inner edge of the passive radiator opening in the speaker enclosure.

Also a configuration such that the speaker enclosure has an enclosure wall having an outside contour and an inside surface and an outside surface, the enclosure wall having a continuous surface outside contour at a passive radiator location in the enclosure wall, a passive radiator opening at the passive radiator location in the enclosure wall extending through the wall from the inside surface of the wall to the outside surface of the wall, the passive radiator opening having an inside perimeter edge configuration; a passive radiator front plate the having an outer surface whose outside contour substantially matches the continuous surface outside contour of the enclosure wall at the passive radiator location in the enclosure wall when positioned within passive radiator opening of the enclosure wall, the passive radiator front plate having an outside perimeter edge configuration complimentarily matching the passive radiator inside perimeter edge configuration such that when the passive radiator front plate is positioned approximately centered within the passive radiator opening of the enclosure wall there is a substantially continuous air gap having a uniform dimension between an outside perimeter edge of the passive radiator front plate and an inside perimeter edge of the enclosure wall in the annular space therebetween, a half annular shaped passive radiator surround having a diametral dimension around a surround annular center at least two times the uniform dimension of the continuous air gap between the outer edge of the passive radiator front plate and the inner edge of the passive radiator opening in the speaker enclosure. Where the half annular shaped passive radiator is positioned to span between and connect the passive radiator front plate and the enclosure wall in proximity to the passive radiator opening in the speaker enclosure such that a center of the diametral dimension of the surround is centered opposite a center of the continuous air gap between the outer edge of the passive radiator front plate and the inner edge of the passive radiator opening in the speaker enclosure. Where the half annular shaped passive radiator is positioned to span between and connect the passive radiator front plate and the enclosure wall in proximity to the passive radiator opening in the speaker enclosure such that an inner diametral perimeter of the surround is positioned located opposite and matching an outer perimeter edge of the passive radiator front plate. Where the half annular shaped passive radiator is positioned to span between and connect the passive radiator front plate and the enclosure wall in proximity to the passive radiator opening in the speaker enclosure such that an outer diametral perimeter of the surround is positioned located opposite and matching an inner perimeter edge of the passive radiator opening in the speaker enclosure. Where the half annular shaped passive radiator surround has a diametral dimension around the surround annular center at least three times the uniform dimension of the continuous air gap between the outer edge of the passive radiator front plate and the inner edge of the passive radiator opening in the speaker enclosure. Where the half annular shaped passive radiator surround has a diametral dimension around the surround annular center at least four times the uniform dimension of the continuous air gap between the outer edge of the passive radiator front plate and the inner edge of the passive radiator opening in the speaker enclosure. The speaker enclosure of any of the embodiments previously described where, the passive radiator front plate is configured to be connected to a radiator frame to support a second connection between the passive radiator front plate and a frame of the passive radiator assembly such that a second surround is positioned between the passive radiator front plate and the frame of the passive radiator assembly to reduce wobble of the passive radiator front plate as it moves with respect to the speaker enclosure. The speaker enclosure of any of the previous descriptions where, the passive radiator front plate is configured to be connected to a radiator frame to support a second connection between the passive radiator front plate and a frame of the passive radiator assembly such that an acoustic radiator spider is positioned between the passive radiator front plate and the frame of the passive radiator assembly to reduce wobble of the passive radiator front plate as it moves with respect to the speaker enclosure. The speaker enclosure of any of the previous embodiments where the front plate is integral with a U-shaped "cone" (actually a closed end hollow cylinder), with a surround shaped element between the "cone" and a passive radiator frame. The speaker enclosure of any of the previous embodiments where the front plate is integral with a U-shaped "cone" (actually a closed end hollow cylinder), with annular shaped elements (inner tube shape with side flange) between the "cone" and the frame.

A method of producing an acoustic radiator enclosure is also disclosed. The method includes identifying an opening in a wall of an acoustic radiator enclosure, the wall having an outside surface and an inside surface surrounding said opening, and mounting an acoustic radiator having a front facing radiating surface whose outer edge is shaped to be complimentary to an inner edge of said opening in said wall, to the inside surface of said wall and aligned with said opening such that an acoustic radiator surround facing said opening overlaps at least one of an inner perimeter edge of opening in said wall or an outer perimeter edge of said front radiating surface. The method may further include directly attaching one edge of the surround to the inside surface and attaching the other edge of the surround to an inside surface of a radiating element of the acoustic radiator, opposite the front facing radiating surface. The method may further include mounting a frame of the acoustic radiator to the inside surface of said wall such that the surround as positioned by said frame is facing a gap between the inner edge of the opening in the wall and the outer edge of a radiating element of the acoustic radiator. The method may further include positioning the front facing radiating surface of the acoustic radiator in line with the outside surface of the wall.

DETAILED DESCRIPTION

Figure 1:
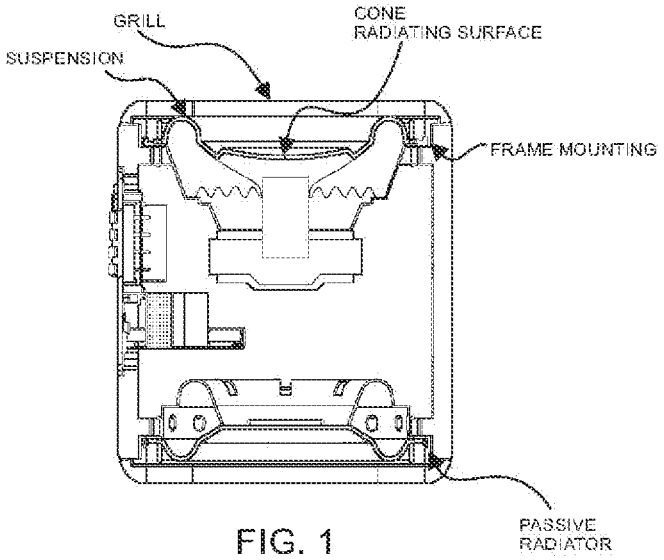
FIG. 1, FIG. 1A, and FIG. 1B are cross-sectional views of a speaker enclosure containing an active radiator at one end and a passive radiator at the other end. These kinds of configurations are well known in the art.
Figure 1A:
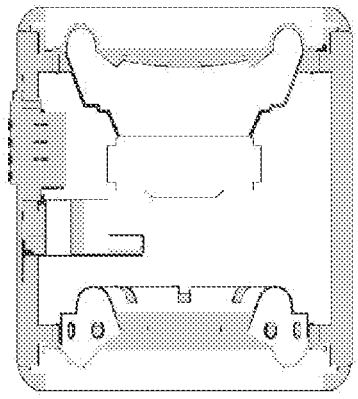
FIG. 1A PRIOR ART
Figure 1B:
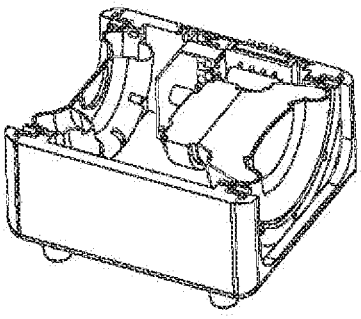

FIG. 1 is a cross-sectional view of a typical speaker enclosure having an active radiator covered by grill on the upper surface and a passive radiator are also covered by grill on the bottom surface of FIGS. 1A and 1B are cross-sections of the cutaway view shown in FIG. 1.

Figure 2A:
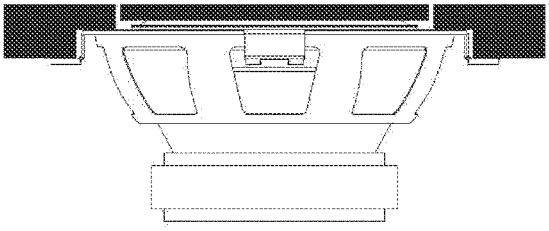
FIGS. 2A and 2B are side and cross-sectional views of an active acoustic radiator with an enclosure exterior surface matching the active radiator moving element (front face) surface.

FIG. 2 shows a side cutaway view of an active acoustic radiator mounted in a speaker enclosure with its central (active) radiating element having an outer surface position substantially matching the surface position of the surrounding speaker enclosure.

Figure 2B:
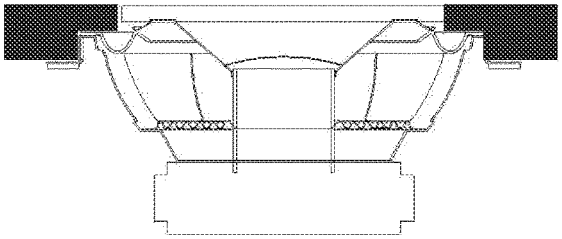

FIG. 2B shows a cross-section through the center of the active radiator showing that the surround of the active radiator is positioned adjacent to the opening in which the active radiator fits, and overlaps the inside perimeter of the opening in which the radiator is located.

Figure 3A:
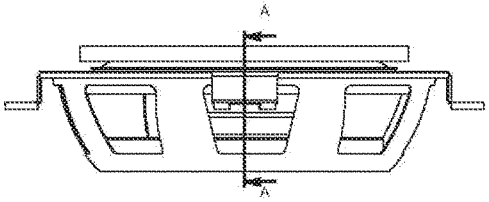
FIGS. 3A and 3B show side and cross-sectional views of a passive radiator system containing a radiating element of the passive radiator having an outside surface matching the contour of the enclosure in which it is mounted.

FIG. 3 shows a side view of a passive radiator mounted in a speaker enclosure with its central radiating element having an outer surface substantially matching the surface of the surrounding speaker enclosure.

Figure 3B:
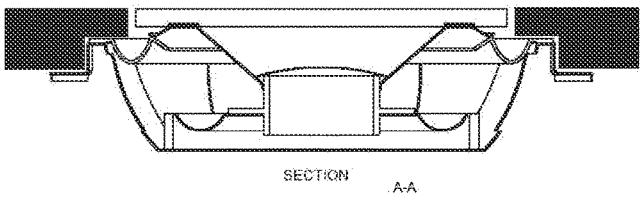

FIG. 3B shows a cross-section through the center of the passive radiator showing that the surround of the passive radiator is located adjacent to the opening in which the passive radiator fits and overlaps the inside perimeter of the opening in which the passive radiator is located.

Figure 4A:
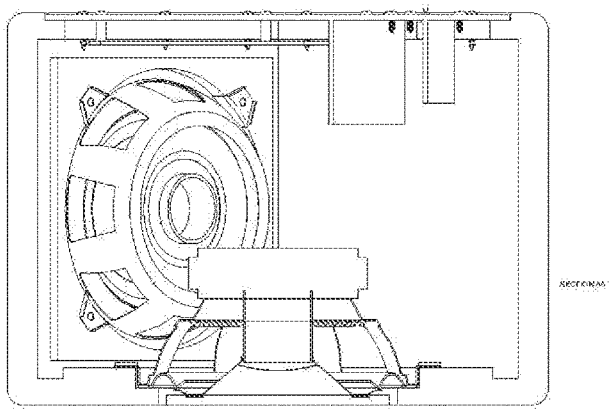
FIGS. 4A, 4B, 4C, 4D, 4E, and 4F picture various perspective cross-sectional and cross-sectional views of a speaker enclosure containing one active radiator on a first wall and passive radiators on adjacent sidewalls of the speaker enclosure.
Figure 4A:
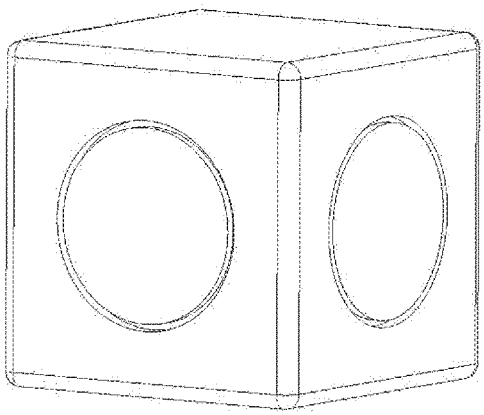
Figure 4B:
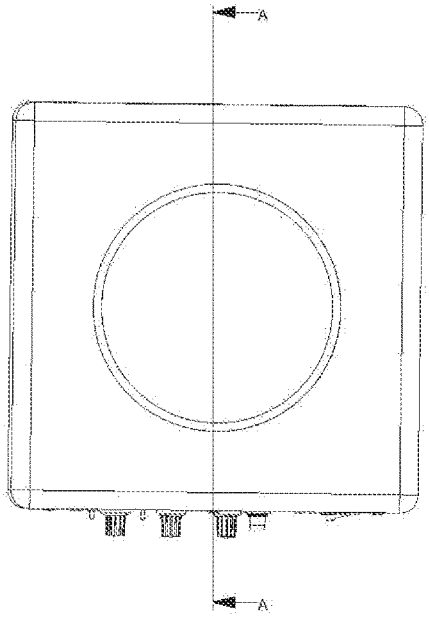
Figure 4C:
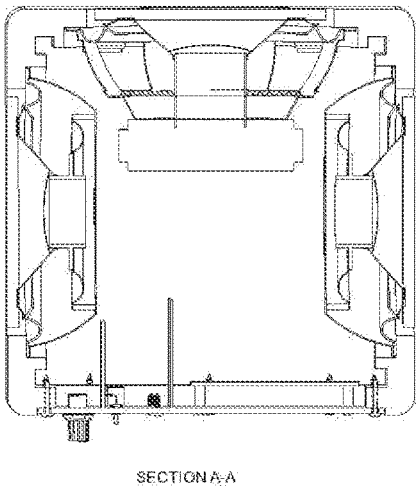
Figure 4D:
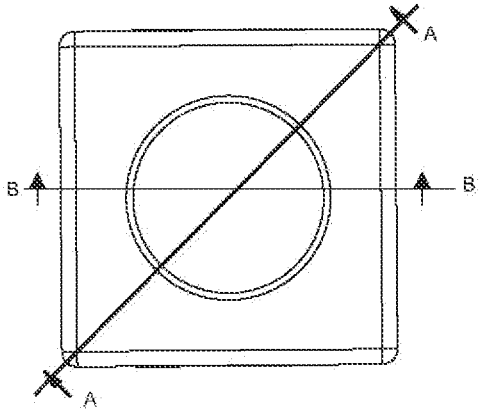
Figure 4E:
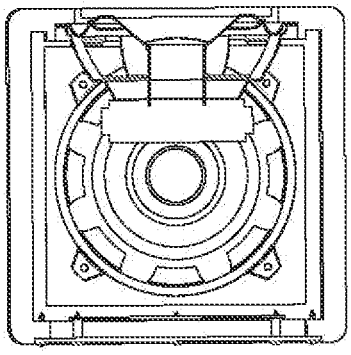
Figure 4F:
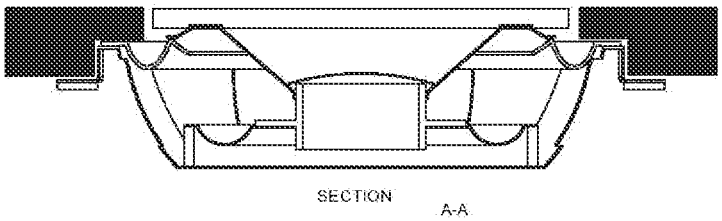

FIGS. 4A, 4B, 4C, 4D, 4E and 4F show perspective and sectional views cutaway of box speaker enclosure. FIG. 4A is a perspective outside view of a speaker enclosure FIG. 4B shows the location of a cut of a side cross-sectional view whose orientation matches the cut which is seen in FIG. 4C with a passive radiator on the left and right at the active radiator in the upper portion of FIG. 4C. FIG. 4D shows a side view with two cross-sectional cuts. The cut through the side of the wall of the enclosure is shown in FIG. 4E where the active radiator is in the upper surface of FIG. 4E, while we see a passive radiator on the opposite wall when half of the box is cut away. A lateral cut as shown in FIG. 4D is shown in FIG. 4E where the active radiator is shown on the bottom surface of 4E while a passive radiator is shown on the lateral (diagonal) wall shown in 4E. FIG. 4F shows a cross-sectional view of either one of the passive radiators shown in FIGS. 4A through 4E showing the configuration of the passive radiator having an outside surface position matching the outside surface position of the surrounding opening of the speaker enclosure with two surrounds. The outer surround overlapping both the inside of the speaker enclosure and the outside of the radiating element of the passive radiator while the second surround is offset from the surface by a cone passive radiator cone and flanged to provide stability and reduce, if not eliminate wobble when acoustic motion is taking place.

Figure 5B:
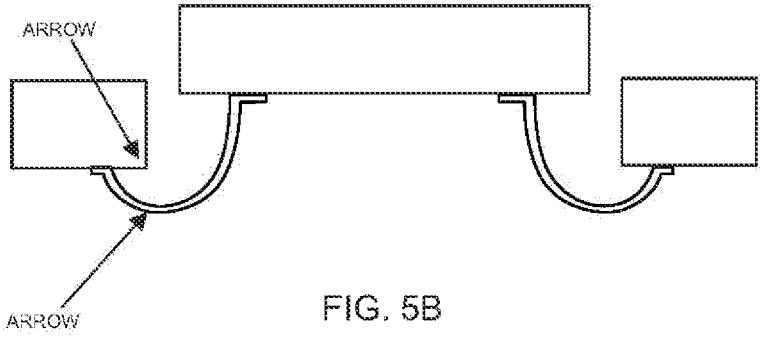
FIGS. 5A, 5B, and 5C illustrate neutral, extended, and withdrawn positions of a passive acoustic radiator system disposed in a speaker enclosure, where the surround overlaps the opening between the speaker enclosure and the front face of the radiating elements with the center of the surround approximately centered over the gap between the speaker enclosure inside perimeter opening and the outside perimeter of the active radiating element (front facing radiating element).
Figure 5A:
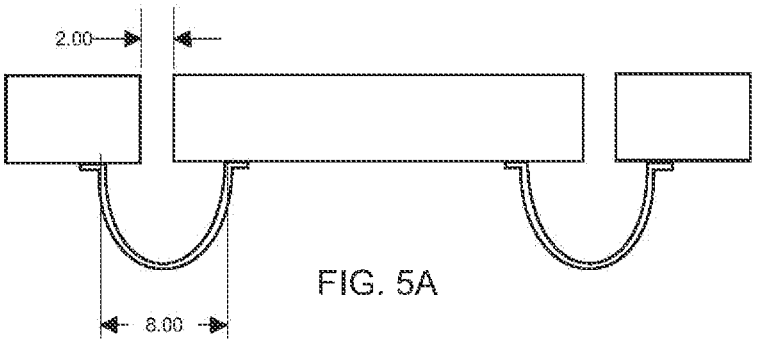
Figure 5C:
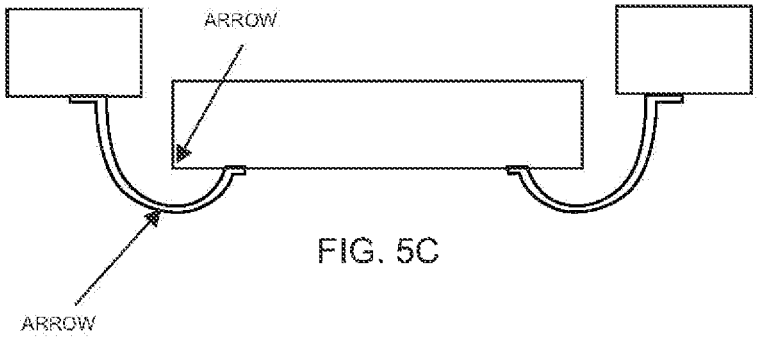

FIGS. 5A, 5B, and 5C illustrate neutral extended and withdrawn positions of a central radiating surface of a passive radiator in an opening of a speaker enclosure where in a neutral position the outside surface of the radiating central radiating element matches the outside surface of the surrounding speaker enclosure.

While only flat plane linear elements are shown in cross-section, it is contemplated and conceivable that the surface of an active or passive radiating element could follow a curved contour outer surface of a speaker enclosure, with the actively moving (radiating) surface preferably mounted in the center of the opening of the speaker enclosure and providing a continuous contour of the speaker enclosure (box) as seen by users.

As shown in FIG. 5A the diameter dimension of the surround is approximately 4 times the dimension of the gap between the outside perimeter edge of the radiating element of the passive radiator and the inside perimeter edge of the opening in which the passive radiator is mounted. As shown in FIG. 5A, the inside edge of the surround substantially overlaps onto the outside edge of the active element of the passive radiator while the outside edge of the surround substantially overlaps the inside edge of opening of the surrounding enclosure. The dimension ratio of 4 to 1 (pictured showing 8 to 2 in FIG. 5A) prevents the lower corner shown by the arrows in FIGS. 5B and 5C of either the inside perimeter edge of the enclosure or the outside perimeter edge of the active element as shown in FIGS. 5B and 5C from contacting and damaging the surround material as shown by the arrow pointing to the corresponding location where the surround may or would contact the respective corner, if the active element of the passive radiator exceeded the expected travel of the passive radiator. The dimension and ratio is chosen so such contact does not take place.

Figure 6B:
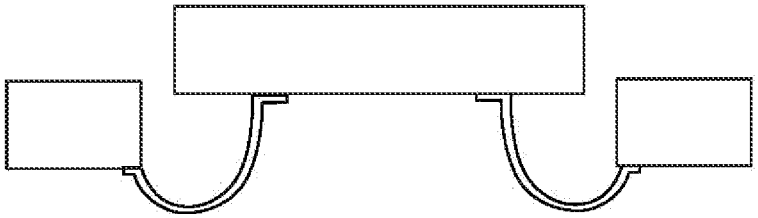
FIGS. 6A, 6B, and 6C illustrate neutral, extended and withdrawn positions of a passive acoustic radiator system disposed in a speaker enclosure, where the surround overlaps the outside perimeter of the radiating element of the front facing passive radiator and whose outside perimeter substantially matches the inside perimeter of the speaker opening in the speaker enclosure in which the passive radiator is mounted.
Figure 6A:
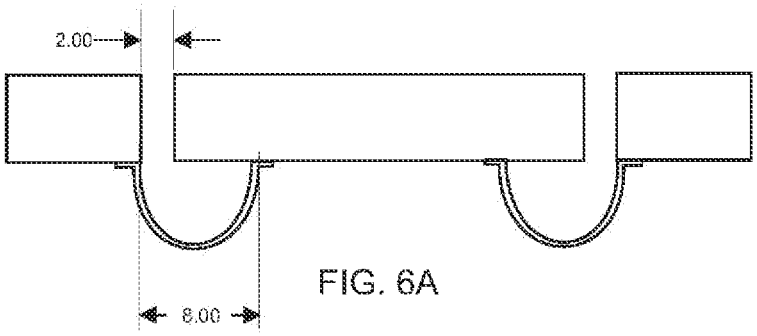
Figure 6C:
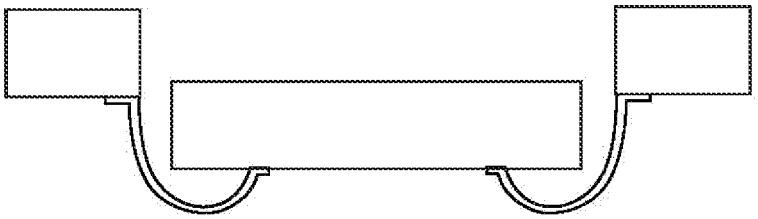

FIGS. 6A, 6B and 6C illustrate the dimensions of a surround whose outside perimeter edge matches the inside perimeter and show opening and a speaker enclosure in which the passive radiator elements is positioned and mounted. In this configuration the inner perimeter edge of the surround substantially overlaps the outside edge of the active element of the passive radiator and is configured to avoid the lower outside edge of the active element (front face) of the passive radiator from contacting the corresponding position on the surround if excessive travel of the active element of the passive radiator were to take place.

Figure 7B:
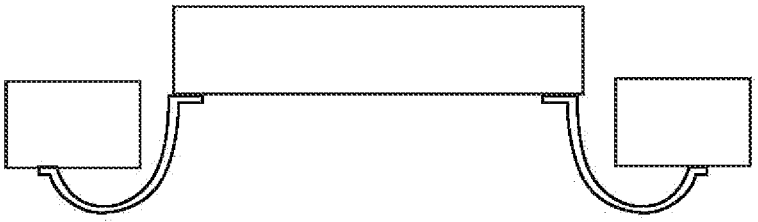
FIGS. 7A, 7B and 7C illustrate neutral, extended, and withdrawn positions of the passive radiator system disposed in a speaker enclosure where the surround overlaps the inside perimeter of the opening in the speaker enclosure in which the passive radiator is mounted and whose inside perimeter substantially matches the outside perimeter of the speaker opening in the speaker enclosure in which the passive radiator is mounted.
Figure 7A:
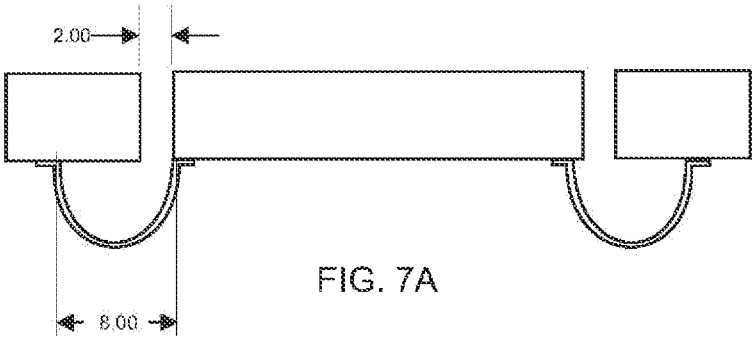
Figure 7C:
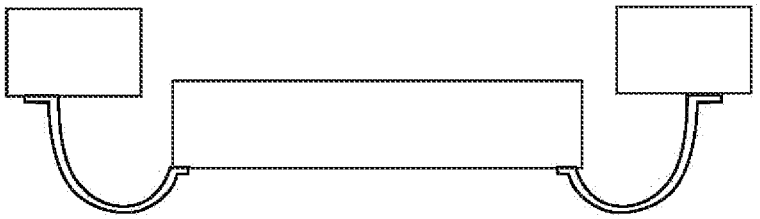

FIGS. 7A, 7B, and 7C illustrate the dimensions of the surround whose inside perimeter edge matches the outside perimeter dimension of the active elements of a passive radiator positioned in the opening of a speaker enclosure. In this configuration the outer perimeter edge of the surround substantially overlaps the inside edge of the opening in the speaker enclosure in which the passive radiator is mounted.

The dimension is of the surround is configured to avoid the lower inside average of the opening in the speaker enclosure in which the active element of the passive radiator is mounted from contacting the corresponding position of the surround if excessive travel of the active element of the passive radiator were to take place.

Figure 8B:
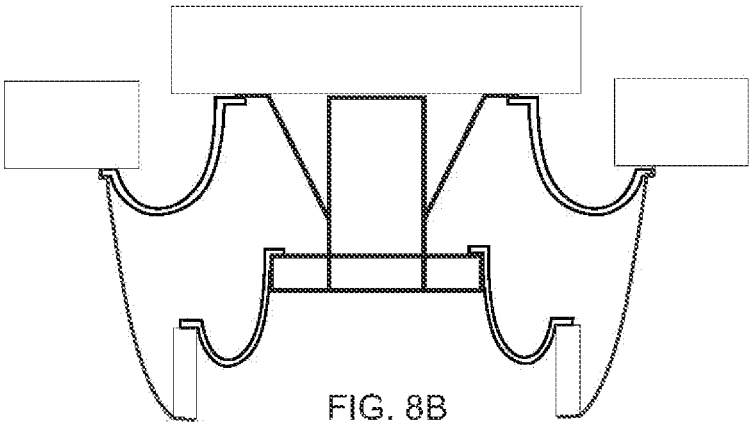
FIGS. 8A, and 8B illustrate a neutral and extended position of a passive radiator having two surrounds, one mounted just inside the wall of the exterior wall of the speaker enclosure with a large overlap surround overlapping on both inside and outside and a second surround mounted from a flanged of a cone extending from the radiating (active) element of the passive radiator to a fixed location on a frame of the passive radiator.
Figure 8A:
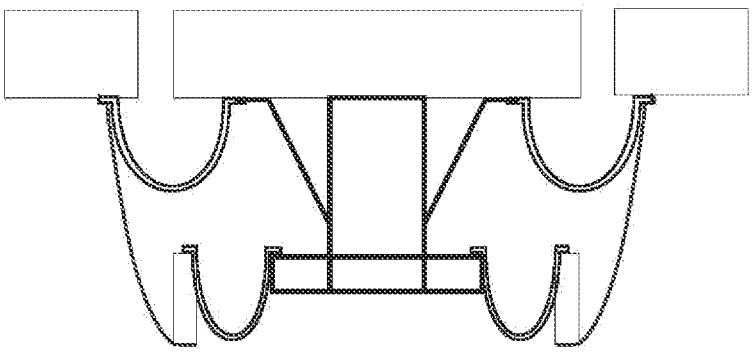

FIGS. 8A and 8B illustrate the neutral and extended positions of a front face of a passive active element of a passive radiator who was outside surface matches the surrounding outside surface of the enclosure wall in which the passive radiator is positioned and mounted. The elements are on the outside surround and outside facing front face of the active element of the passive radiator is similar to those earlier described in FIGS. 5A and 5B however, in this instance, a cone and frame and a second surround are positioned inside the enclosure to provide guidance and stability and to minimize wobble during the motion of the active element of the passive radiator.

Figure 9:
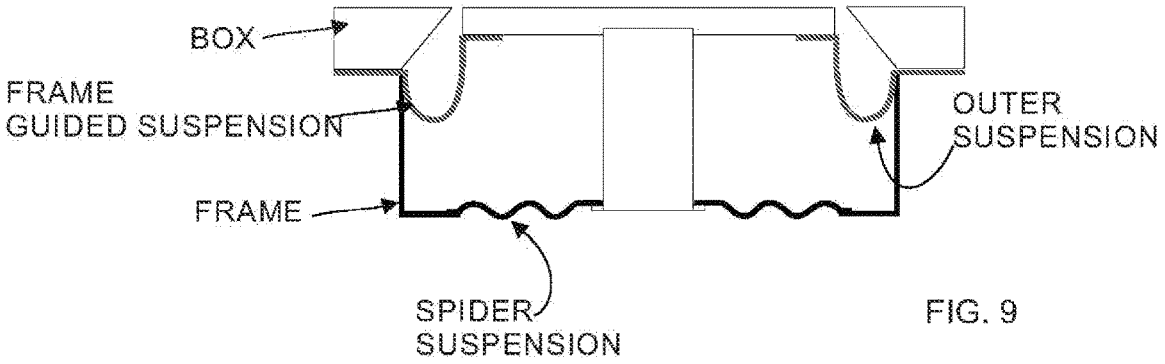
FIG. 9 schematically illustrates a cross-section of a passive radiator having a front facing radiating face matching the front outside dimension of a speaker enclosure with an outer an outer suspension surround overlapping the inside perimeter of the opening in which the passive radiator is positioned and also includes a spider suspension attaching between a frame and a flange of a cone of the passive radiator radiating (active) element.

FIG. 9 shows a cross-sectional view of an alternate arrangement of a passive radiator of the type shown in FIGS. 8A and 8B except that the edge of the box enclosure is slanted from the outside towards the opening and the surround mounted at the active element of the passive radiator is mounted to the bottom of the radiator front face element, which in this embodiment is not as thick as the adjacent enclosure wall, however a frame is provided to which a spider suspension is attached between the frame and a back part of the cone to stabilize the motion of the active element of the passive radiator when it is in motion.

Figure 10:
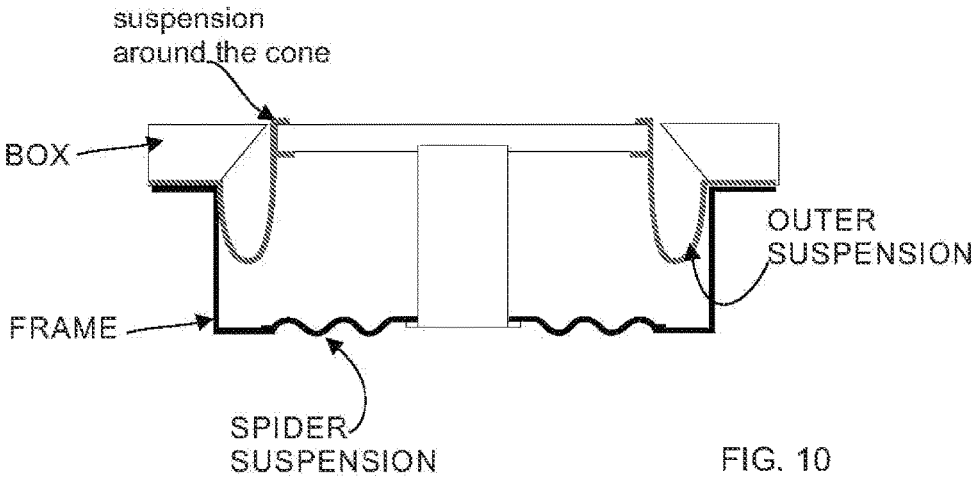
FIG. 10 schematically illustrates a cross-section of the passive radiator having a front facing radiating face matching the front outside dimension of speaker enclosure with an outer suspension whose inner attachment to the radiating element wraps around the perimeter edge of the front face and also includes a spider suspension attaching between a frame and a flanged of the cone of the pasty passive radiator radiating (active) element.

FIG. 10 shows an alternate arrangement of the configuration of FIG. 9 where the suspension wraps around the perimeter of the active front face element of the passive radiator and shows a slightly more lengthy surround suspension cross-sectional dimension for the surround at that location.

Figure 11:
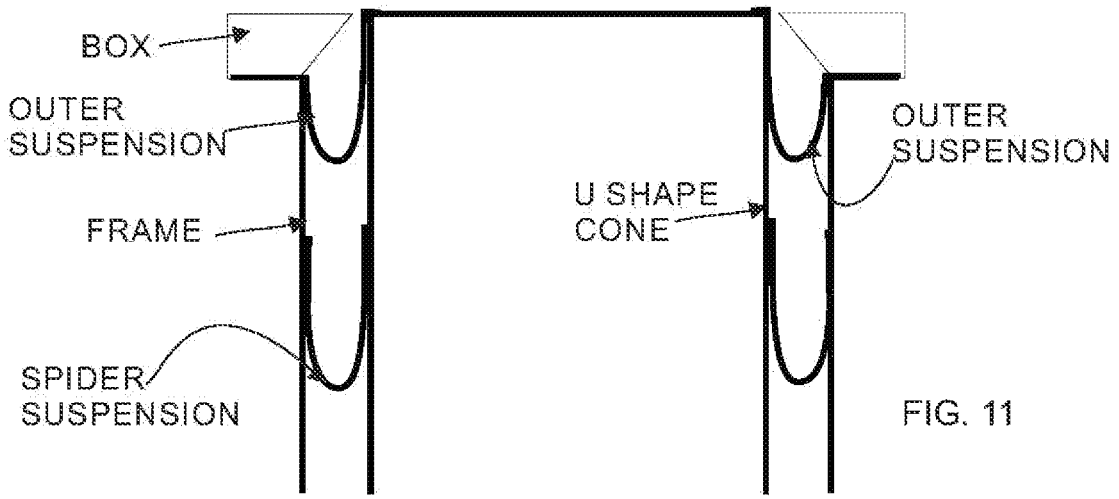
FIG. 11 shows a schematic cross-sectional view of an alternate arrangement of a front facing radiating element of passive radiator fitted in an opening of a speaker enclosure where a U-shaped cone element is suspended in the opening by a between a frame and the U-shaped element using two sets of surround elements.

FIG. 11 provides an alternate arrangement of a passive radiator having a U-shaped cone still with a front face whose outer surface position substantially matches the adjacent outer surface position of the speaker enclosure (box). The U-shaped cone could be a cylindrical or other, geometrically shaped tube having a closed end where the walls of the tube are mounted with two outer suspensions between a frame of the passive radiating elements and the active portion (U-shaped cone) of the passive radiating element. In FIG. 11, the outer suspension is consists of two surrounds mounted along the in the axis of the motion of the passive radiating element to provide guidance and reduce wobble as discussed above for other dual suspension radiating elements.

Figure 12:
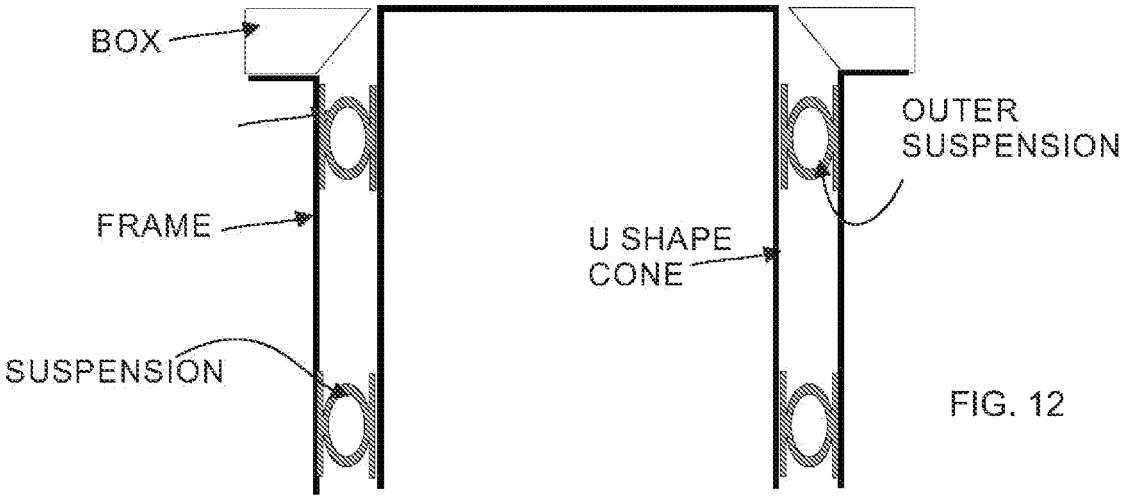
FIG. 12 is a similar configuration as shown in FIG. 11 except that instead of surround elements there are circular and the annular suspension elements have flanges one of each of which attaches to the U-shaped cone while the other attaches to a frame of the passive radiating element.

FIG. 12 shows an alternate arrangement of the configuration of FIG. 11, except that instead of a simple half circle (half annular) shaped surround acting as the two suspensions in FIG. 12, a full circle surround (flexible suspension element) is mounted at two locations with a flange elements of the full circle annular mounted on opposite sides of the surround such that the motion of the surround is a rolling one which allows for tuning, if higher forces are needed than provide in a half open surround element.

While the invention has been described with regard to specific embodiments, those skilled in the art will recognize that chances can be made in form and detail without departing from the spirit and scope of the invention.

The invention claimed is:

1. A speaker enclosure comprising:

an enclosure wall having an inside surface and an outside surface;

said enclosure wall having a continuous surface at a passive radiator location in said enclosure wall;

a passive radiator opening at said passive radiator location in said enclosure wall extending through said wall from said inside surface of said wall to said outside surface of said wall, said passive radiator opening having an inside perimeter edge configuration;

a passive radiator front plate configured to attach to said enclosure wall at said passive radiator location in said enclosure wall when positioned within passive radiator opening of said enclosure wall;

said passive radiator front plate having an outside perimeter edge configuration complimentarily matching said passive radiator inside perimeter edge configuration such that when the passive radiator front plate is positioned approximately centered within said passive radiator opening of said enclosure wall there is a substantially continuous air gap having a uniform dimension between an outside perimeter edge of said passive radiator front plate and an inside perimeter edge of said enclosure wall in the annular space therebetween; and a half annular shaped passive radiator surround having a diametral dimension around a surround annular center at least two times said uniform dimension of said continuous air gap between said outer edge of said passive radiator front plate and said inner edge of said passive radiator opening in said speaker enclosure.

2. The speaker enclosure of claim 1, wherein said half annular shaped passive radiator is positioned to span between and connect said passive radiator front plate and said enclosure wall in proximity to said passive radiator opening in said speaker enclosure such that a center of said diametral dimension of said surround is centered opposite a center of said continuous air gap between said outer edge of said passive radiator front plate and said inner edge of said passive radiator opening in said speaker enclosure.

3. The speaker enclosure of claim 1, wherein said half annular shaped passive radiator is positioned to span between and connect said passive radiator front plate and said enclosure wall in proximity to said passive radiator opening in said speaker enclosure such that an inner diametral perimeter of said surround is positioned located opposite and matching an outer perimeter edge of said passive radiator front plate.

4. The speaker enclosure of claim 1, wherein said half annular shaped passive radiator is positioned to span between and connect said passive radiator front plate and said enclosure wall in proximity to said passive radiator opening in said speaker enclosure such that an outer diametral perimeter of said surround is positioned located opposite and matching an inner perimeter edge of said passive radiator opening in said speaker enclosure.

5. The speaker enclosure of claim 1, wherein said half annular shaped passive radiator surround has a diametral dimension around the surround annular center at least three times said uniform dimension of said continuous air gap between said outer edge of said passive radiator front plate and said inner edge of said passive radiator opening in said speaker enclosure.

6. The speaker enclosure of claim 1, wherein said half annular shaped passive radiator surround has a diametral dimension around the surround annular center at least four times said uniform dimension of said continuous air gap between said outer edge of said passive radiator front plate and said inner edge of said passive radiator opening in said speaker enclosure.

7. The speaker enclosure of claim 1, wherein said passive radiator front plate is configured to be connected to a radiator frame to support a second connection between said passive radiator front plate and a frame of said passive radiator assembly such that a second surround is positioned between said passive radiator front plate and said frame of said passive radiator assembly to reduce wobble of said passive radiator front plate as it moves with respect to said speaker enclosure.

8. The speaker enclosure of claim 1, wherein said passive radiator front plate is configured to be connected to a radiator frame to support a second connection between said passive radiator front plate and a frame of said passive radiator assembly such that an acoustic radiator spider is positioned between said passive radiator front plate and said frame of said passive radiator assembly to reduce wobble of said passive radiator front plate as it moves with respect to said speaker enclosure.

9. The speaker enclosure of claim 1, wherein the front plate is integral with a U-shaped "cone", said "cone" being a closed end hollow cylinder, with a surround shaped element between the "cone" and a passive radiator frame.

10. The speaker enclosure of claim 1, wherein the front plate is integral with a U-shaped "cone", said "cone" being a closed end hollow cylinder, with annular shaped elements, said annual shaped elements being inner tube shaped with a side flange, between the "cone" and the frame.

11. A method of producing an acoustic radiator enclosure comprising the steps of:

identifying an opening in a wall of an acoustic radiator enclosure, the wall having an outside surface and an inside surface surrounding said opening; and mounting an acoustic radiator having a front facing radiating surface whose outer edge is shaped to be complimentary to an inner edge of said opening in said wall, to the inside surface of said wall and aligned with said opening such that an acoustic radiator surround facing said opening overlaps at least one of an inner perimeter edge of opening in said wall or an outer perimeter edge of said front radiating surface.

12. The method of claim 11, wherein the step of mounting includes directly attaching one edge of the surround to the inside surface and attaching the other edge of the surround to an inside surface of a radiating element of the acoustic radiator, opposite the front facing radiating surface.

13. The method of claim 11, wherein the step of mounting includes mounting a frame of the acoustic radiator to the inside surface of said wall such that the surround as positioned by said frame is facing a gap between the inner edge of the opening in the wall and the outer edge of a radiating element of the acoustic radiator.

14. The method of claim 11, wherein the step of mounting includes positioning the front facing radiating surface of the acoustic radiator in line with the outside surface of the wall.

15. A speaker enclosure comprising:

an enclosure wall having an outside contour and an inside surface and an outside surface;

said enclosure wall having a continuous surface outside contour at a passive radiator location in said enclosure wall;

a passive radiator opening at said passive radiator location in said enclosure wall extending through said wall from said inside surface of said wall to said outside surface of said wall, said passive radiator opening having an inside perimeter edge configuration;

a passive radiator front plate said having an outer surface whose outside contour substantially matches said continuous surface outside contour of said enclosure wall at said passive radiator location in said enclosure wall when positioned within passive radiator opening of said enclosure wall;

said passive radiator front plate having an outside perimeter edge configuration complimentarily matching said passive radiator inside perimeter edge configuration such that when the passive radiator front plate is positioned approximately centered within said passive radiator opening of said enclosure wall there is a substantially continuous air gap having a uniform dimension between an outside perimeter edge of said passive radiator front plate and an inside perimeter edge of said enclosure wall in the annular space therebetween; and a half annular shaped passive radiator surround having a diametral dimension around a surround annular center at least two times said uniform dimension of said continuous air gap between said outer edge of said passive radiator front plate and said inner edge of said passive radiator opening in said speaker enclosure.

16. The speaker enclosure of claim 15, wherein said half annular shaped passive radiator is positioned to span between and connect said passive radiator front plate and said enclosure wall in proximity to said passive radiator opening in said speaker enclosure such that a center of said diametral dimension of said surround is centered opposite a center of said continuous air gap between said outer edge of said passive radiator front plate and said inner edge of said passive radiator opening in said speaker enclosure.

17. The speaker enclosure of claim 15, wherein said half annular shaped passive radiator is positioned to span between and connect said passive radiator front plate and said enclosure wall in proximity to said passive radiator opening in said speaker enclosure such that an inner diametral perimeter of said surround is positioned located opposite and matching an outer perimeter edge of said passive radiator front plate.

18. The speaker enclosure of claim 15, wherein said half annular shaped passive radiator is positioned to span between and connect said passive radiator front plate and said enclosure wall in proximity to said passive radiator opening in said speaker enclosure such that an outer diametral perimeter of said surround is positioned located opposite and matching an inner perimeter edge of said passive radiator opening in said speaker enclosure.

19. The speaker enclosure of claim 15, wherein said half annular shaped passive radiator surround has a diametral dimension around the surround annular center at least three times said uniform dimension of said continuous air gap between said outer edge of said passive radiator front plate and said inner edge of said passive radiator opening in said speaker enclosure.

20. The speaker enclosure of claim 15, wherein said half annular shaped passive radiator surround has a diametral dimension around the surround annular center at least four times said uniform dimension of said continuous air gap between said outer edge of said passive radiator front plate and said inner edge of said passive radiator opening in said speaker enclosure.

* * * * *